US005933874A

United States Patent [19]

Randolph

[11] Patent Number: 5,933,874

[45] Date of Patent: Aug. 10, 1999

[54] CHEST PROTECTOR

[76] Inventor: Michael Randolph, 5515 S. Grammercy Pl., Los Angeles, Calif. 90062

[21] Appl. No.: 09/138,727

[22] Filed: Aug. 24, 1998

Related U.S. Application Data

[60] Provisional application No. 60/056,699, Aug. 27, 1997.

[51] Int. Cl.[6] ..... A41D 13/00

[52] U.S. Cl. ..... 2/463; 2/455; 2/338; 2/267; 482/93; 482/106

[58] Field of Search ..... 2/463, 464, 456, 2/455, 92, 338, 267, 44; 482/105, 93, 106, 104

[56] References Cited

U.S. PATENT DOCUMENTS

| | | | |
|---|---|---|---|
| 4,272,847 | 6/1981 | Buhler | 2/2 |
| 4,317,237 | 3/1982 | Porte | 2/2 |
| 4,394,012 | 7/1983 | Egbert et al. | 2/251 |
| 4,413,357 | 11/1983 | Sacks | 2/2.5 |
| 4,953,856 | 9/1990 | Fox | 272/119 |
| 4,989,267 | 2/1991 | Watson | 2/102 |
| 5,002,270 | 3/1991 | Shine | 272/119 |
| 5,245,706 | 9/1993 | Moschetti et al. | 2/2 |
| 5,433,686 | 7/1995 | Marsh | 482/104 |
| 5,588,940 | 12/1996 | Price et al. | 482/105 |
| 5,716,307 | 2/1998 | Vadher | 482/125 |
| 5,768,706 | 6/1998 | Griffith et al. | 482/105 |

*Primary Examiner*—John J. Calvert
*Assistant Examiner*—Tejash D Patel
*Attorney, Agent, or Firm*—Roger A. Marrs

[57] ABSTRACT

An upper body or chest protector includes a pad having a case occupied by a block of cellular foam adapted to be compressed upon receipt of impact loading. Neck and body girth straps are employed to detachably retain the pad in place on the chest of the user. The body girth straps may include a pair of support straps that downwardly depend from the pad and loop about a waist belt.

7 Claims, 1 Drawing Sheet

CHEST PROTECTOR

Priority claimed based on Ser. No. 60-056,699 filed Aug. 27, 1997

BACKGROUND OF THE INVENTION

1. Field of the Invention

The present invention relates to the field of exercising equipment and accessories, and more particularly to a novel protector adapted to be worn by a person engaging in an exercising procedure in order to protect the chest or upper torso in the event of an inadvertent lowering or dropping of weights during the procedure.

2. Brief Description of the Prior Art

In the past, it has been the conventional practice when employing free weights to perform an exercise such as a bench press by which the person engaging in the exercise raises and lowers a weighted bar while in a prone position. In some instances, safety is achieved by using another person as a "spotter" so that the spotter may temporarily relieve the pressure of the weights from the person performing the exercise. However, in most instances, a spotter is not used and should the person performing the exercise over-exert himself, the weight bar may drop or rapidly lower and the center of the bar may fall against the chest or upper torso of the user, causing damage and injury.

Some attempts have been made to provide torso protection during the playing of sports or games which usually involve thick padding or inflatable bladders which are intended to absorb shock and load-bearing forces during impact of baseballs, footballs, hockey pucks or the like. Although such protection has been found useful, such devices are not applicable for weight lifting purposes and are therefore not used. Generally, such prior torso protectors are bulky and cannot be comfortably worn by a person engaged in personal exercising.

Therefore, a long-standing need has existed to provide a chest protector which is comfortable and which may be readily worn by a person engaged in extensive body maneuvering and manipulation in order to practice given exercises. Such a protector must include shock absorbing as well as load distribution characteristics in order to fully protect the user.

SUMMARY OF THE INVENTION

Accordingly, the above problems and difficulties have been avoided by the present invention which provides a novel upper torso or body protector which includes a pad having an inner core composed of a soft cell. material, such as foam or the like, and the core is wrapped transversely with a fabric material having the ability to contract upon impact of load forces. The wrapped core is covered with a fabric cover material and the cover may take the form of a bag into which the wrapped foam core is insertably received through an opening. The upper end of the pad includes a buckled adjustable neck strap while the lower end of the pad includes a pair of bottom straps including buckles which are intended to be releasably attached to the weight belt of the exerciser.

Therefore, it is among the primary objects of the present invention to provide a chest protector for a person engaged in raising and lowering free weights.

Another object of the present invention is to provide a novel chest protector which includes a constricting means about a foam pad which assists in load distribution and impact absorption upon impact by an inadvertently released weighted bar.

Yet another object of the present invention is to provide a novel chest protector for weight lifters utilizing free weight which may readily be worn about the neck of the user extending across the chest and terminating in a releasable connection with the user's waist belt.

A further object resides in providing a chest protector having an elongated block of compressible foam composition enclosed by a soft fabric or leather bag or cover that is held in place on the weight lifter by an adjustable neck strap and belt straps for wrapping about the waist of the user or detachably connectable with a weight belt.

An object resides in a chest protector having a collapsible or compressible block of material adapted to depress as weight forces are applied while load or impact forces are absorbed by and through the material.

Another object resides in using adjustable straps on a chest protector for weight lifters for comfortably retaining the protector in position on the lifter's chest providing unrestricted arm, leg and body movement.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
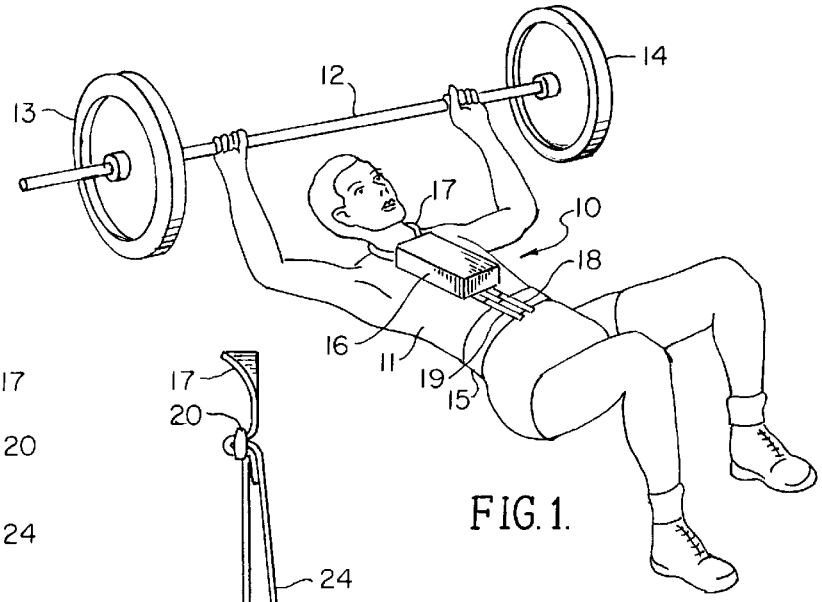
FIG. 1 is a front perspective view showing a weight lifter wearing the novel chest protector or upper torso protector of the present invention.

Referring to FIG. 1, the novel chest protector of the present invention is illustrated in the general direction of arrow 10 which is illustrated as being worn on a weight lifter 11 who is in a prone position. While in this position, a typical exercise is known as a bench press and the exerciser or weight lifter 11 may be reclined on a bench or may be on a flat floor. In either instance, free weights are being used in the form of a weighted bar having an elongated bar 12 on which disc weights 13 and 14 are carried on the opposite ends thereof. It can also be seen that the weight lifter 11 is wearing a waist belt 15 as is the normal practice when performing weight lifting procedures.

The chest protector 10 includes a pad 16 having an upper end with an adjustable strap 17 placed about the back of the neck or nape of the user while the lower end of the pad 16 includes a pair of bottom straps 18 and 19 which are detachably connected to the front of the waist belt 15. When the chest protector is worn, as illustrated, the upper torso and chest of the user are protected in the event the weighted bar 12 is released while the bar is above the weight lifter. Any impact of the bar against the pad will be shock absorbed and the load will be distributed through the straps to the body of the user. Therefore any impacted loads will not be concentrated in the chest area which would cause injury.

Figure 2:
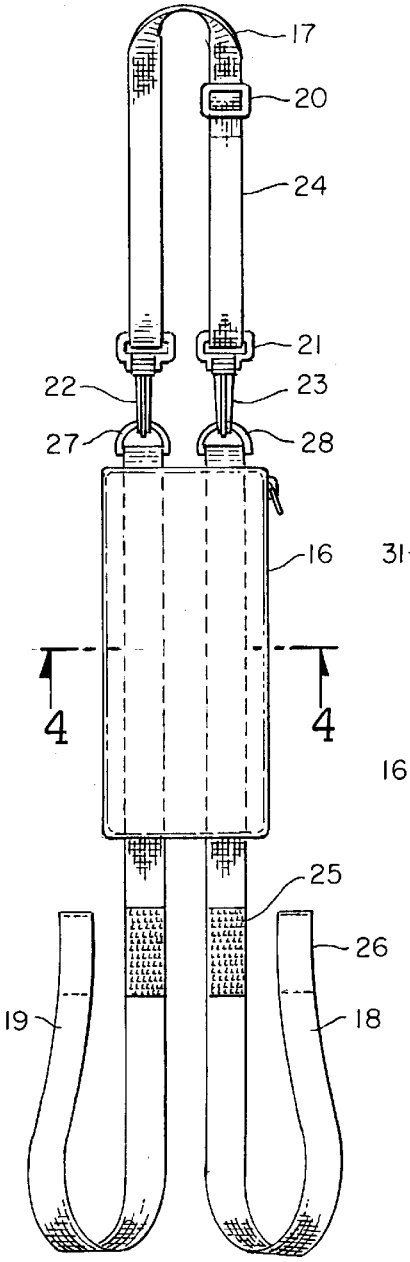
FIG. 2 is a front view of the protector.

Referring now to FIG. 2, the pad 16 is illustrated with the necks trap 17 having adjustable means 20 and 21 that releasably connect with the pad or block 16 by means of manually operated snaps 22 and 23. It can be seen that the necks trap 17 includes a loop 24 since the strap is folded over upon itself through the fastener 21. This is more clearly seen in FIG. 3. If desired, hook and pile fasteners may may be used or plastic tongue and groove buckles may be employed, if desired. It can also be seen in FIG. 2 that the bottom straps 18 and 19 may include releasable fasteners in the form of hook and pile fasteners, identified by components 25 and 26. The pile component, for example, is carried on the inside of strap 18 while the hook portion or component of the fastener is connected on the terminating end of the strap, as identified by numeral 26. The same relationship of the two-component detachable fastener is carried on strap 19. It can be seen that the straps 18 and 19 have eyelets 27 and 28 at their opposite ends so as to receive the snap fasteners 22 and 23. Therefore, the pad or block 16 is further supported by being attached to the straps as the straps are sewn or otherwise secured to the back side of the pad. The full length of each strap 18 and 19 extends from the eyelets 27 and 28 behind the pad 16 and then downwardly depends in a loose fashion until it is desired to fasten the straps 18 and 19 around the weight belt 15. In this instance, the straps are passed behind the belt 15 and folded over the front part of the belt for securement between the two components 25 and 26. An alternate means of releasably securing the pad to the waist of the user would be to cause the straps 18 and 19 to be brought about the waist of the user and having the two components fasten together at the back of the user. Alternately, the straps may be folded as previously described with regard to the weight belt but a separate waist belt can be employed for passing through the loops.

Figure 3:
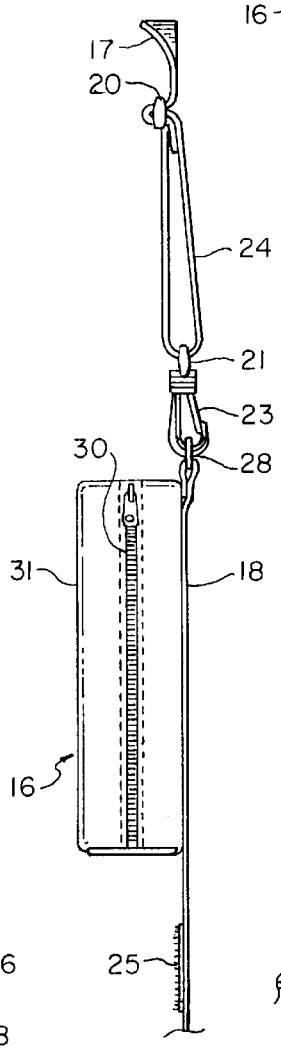
FIG. 3 is a side elevational view of the chest protector shown in FIG. 2.

FIG. 3 illustrates that the pad 16 may include a cover that is provided with a zipper or alternate closure, as identified by numeral 30. The zipper or closure 30 is placed in a cover 31 which may take the form of a fabric material, leather, leatherette, or other suitable soft and pliable material. It can also be seen that the straps 18 and 19 are secured to the back of the cover 31 of the pad 16 and that the loop 24 of the necks trap 17 passes through the eyelet 21 associated with snap fastener 23. It is also to be understood that the zipper or closure 30 need not be provided in the enclosing cover.

Figure 4:
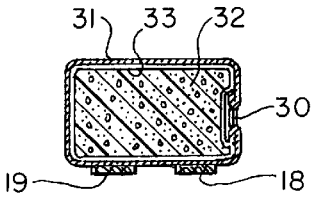
FIG. 4 is an enlarged transverse cross-sectional view of the protection pad or block shown in FIG. 2 as taken in the direction of arrows 4—4 thereof.

As indicated in FIG. 4, the chest protector includes an inner core of foam material, represented by numeral 32. The shape of the material is elongated and the core is wrapped or covered by means of a length of protective plastic sheet material 33. The sheet material 33 is more clearly indicated in FIG. 6 wherein it can be seen that the block core 32 is completely covered. The wrap or sheet of material 33 is relatively loose about the core 32 so that should there be any impact, the wrap will contract about the core to absorb any shock as well as to distribute impact loading. The wrap core 32 is covered by the cover material 31 which may take the form of a bag having an opening through which the wrap core is inserted followed by closing the bag or cover by means of the zipper 30 or such as by stitching or the like.

Figure 6:
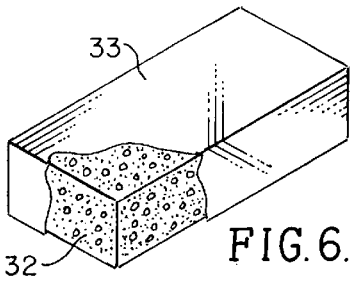
FIG. 6 is a perspective view of the protector absorbing pad or block illustrating the block as a wrapped core preparatory to insertion into a cover.

Referring further to FIGS. 4 and 6, it can be seen that the foam block or core 32 may be of an open or closed cell variety depending on the amount of load distribution intended to be encountered during usage. Because of the foam material used in the core 32, the chest protector is very light and does not impede nor number the weight lifter during any exercising procedure.

Figure 5:
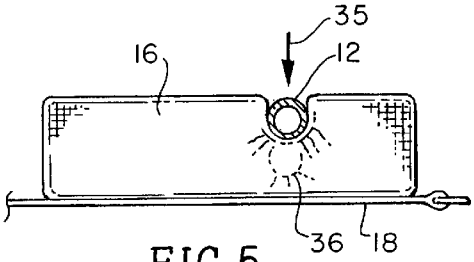
FIG. 5 is a side elevational view of the protector pad or block compressing in response to application of a weighted load.

Referring now in detail to FIG. 5, it can be seen that should the bar 12 of the weight impact the pad or block 16, as indicated in the direction of arrow 35, the foam core 32 as well as the sheet protection 33 will compress. The bar, as illustrated in solid lines, is in a midway position, but it is to be understood that the bar may depress almost to the strap 18 in the event of greater impact loading. Such depression is further indicated in broken lines where the bottom of the depression is indicated by numeral 36. Load forces generated due to the impacting are distributed radially from the point of impact and eventually may be passed through the straps for diverse distribution to the user and either the floor or weight bench. The main point being that the impact load is distributed and not concentrated on the chest of the weight lifter.

In view of the foregoing, it can be seen that the chest protector of the present invention may be comfortably adjusted to be worn by the weight lifter in a variety of exercising positions. Also, by anchoring or securing the bottom of the pad or block 16 to the weight lifting belt 15 or by any other waist securing means, assurance is given that the pad will stay in the proper position during the exercising procedure. Also, any impact loads received by the pad or block 16 will be distributed through the straps 18 and 19.

Note is taken that the elongated straps 18 and 19 are secured to the backside of the pad 16 wherein the ends of the straps extend beyond the top and bottom of the pad. The top ends terminate in rings 27 and 28 and the lower ends downwardly depend to provide belt or waist straps. Therefore, when worn, load forces from the neck to the waist or belt are maintained along the length of the straps. No loading forces are through the pad except those forces encountered via the weight.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A chest protection device for use during an exercise procedure comprising:

an elongated compressible pad having an exposed front surface and a rear surface contacting the chest of the user;

a pair of straps secured to said rear surface of said pad in fixed parallel spaced-apart relationship downwardly depending to terminate with adjustable fasteners;

a neck strap having opposite ends detachably connectable to each of said pair of straps;

a waist belt adapted to receive said pair of strap fasteners whereby said pair of straps, said waist belt and said neck strap support and retain said pad in an operative position on the chest of the user for protection against impact loads.

2. The protection device defined in claim 1 wherein:

said core is composed of a high density cellular foam composition; and a plastic sheet of pliable material wrapped about said core and adapted to be compliant with compression of said core upon receipt of impact loading.

3. The protection device defined in claim 2 wherein:

said pad includes a pliable case enclosing said core and said sheet within an interior storage compartment; and a zippered closure in said case selectively operable to gain access to said core in said storage compartment.

4. The protection device defined in claim 1 wherein:

said pair of straps are elongated and include top ends terminating in rings and lower ends terminating in said adjustable fasteners;

said neck straps ends releasably connected to said rings; and said lower ends adapted to loop about said waist belt whereby load forces from said neck strap travel via said pair of straps to said waist belt without passing through said pad.

5. The protection device defined in claim 1 wherein:

said pad is a foam core is composed of an open cellular material whereby said foam core is adapted to compress its width upon impact of a load force thereto.

6. The protection device defined in claim 1 wherein:

said pad is characterized as distributing impacting load forces away from a point of impact towards said ends of said pad for transfer via said strap means to load absorbing means.

7. The protector device defined in claim 1 wherein:

an enclosure disposed about said pad; and said enclosure includes a zipper closure for gaining access to the interior of said enclosure and to said pad.

* * * * *